US006802458B2

(12) United States Patent
Gregory

(10) Patent No.: US 6,802,458 B2
(45) Date of Patent: Oct. 12, 2004

(54) SPRINKLER WITH NOZZLE GATE VALVE

(75) Inventor: Christian T. Gregory, La Crescenta, CA (US)

(73) Assignee: Rain Bird Corporation, Glendora, CA (US)

( * ) Notice: Subject to any disclaimer, the term of this patent is extended or adjusted under 35 U.S.C. 154(b) by 325 days.

(21) Appl. No.: 10/079,469

(22) Filed: Feb. 21, 2002

(65) Prior Publication Data

US 2003/0155433 A1 Aug. 21, 2003

(51) Int. Cl.[7] ..... B05B 15/10
(52) U.S. Cl. ..... 239/205; 239/242; 239/580
(58) Field of Search ..... 239/237, 240, 239/241, 242, 246, 203, 204, 205, 206, DIG. 1, 390, 391–394, 569, 583, 591, 580

(56) References Cited

U.S. PATENT DOCUMENTS 5,762,270 A 6/1998 Kearby et al.
6,000,632 A * 12/1999 Wallace ..... 239/204
6,241,158 B1 * 6/2001 Clark et al. ..... 239/1
6,499,678 B1 * 12/2002 Hope ..... 239/581.1
6,568,608 B2 * 5/2003 Sirkin ..... 239/569

* cited by examiner

*Primary Examiner*—Michael Mar
*Assistant Examiner*—Thach H. Bui
(74) *Attorney, Agent, or Firm*—Fitch, Even, Tabin & Flannery

(57) ABSTRACT

A nozzle gate valve is provided in an irrigation sprinkler for quick and easy shut-off of water flow to a sprinkler spray nozzle. The gate valve is mounted within a sprinkler spray head at an upstream side of the nozzle for displacement between open and closed positions respectively permitting and preventing waterflow to the nozzle. In the preferred form, the gate valve has a generally conical shape and defines an elbow-shaped flow path movable between the open position aligned with the nozzle for normal water supply thereto, and the closed position misaligned with the spray nozzle to prevent water flow thereto. In the closed position, the spray nozzle can be removed and/or replaced, or other sprinkler adjustments can be performed, without requiring a main system water supply to be turned off.

37 Claims, 7 Drawing Sheets

SPRINKLER WITH NOZZLE GATE VALVE

BACKGROUND OF THE INVENTION

This invention relates generally to improvements in irrigation sprinklers of the type having internal valve means for selectively turning off the water flow to an individual sprinkler spray head. More particularly, this invention relates to an improved nozzle gate valve mounted within a sprinkler spray head at the upstream side of a spray nozzle for quick and easy movement between a normal open position for substantially unobstructed water flow to and through the nozzle, and a closed position shutting off the water flow to the nozzle to accommodate facilitated nozzle removal and/or replacement or other sprinkler adjustments.

Irrigation sprinkler devices are generally known in the art to include a spray head having at least one spray nozzle through which a stream of irrigation water is projected outwardly to irrigate surrounding terrain and associated vegetation. In one common form, the sprinkler device incorporates water-powered rotary drive means for rotating the spray head about a typically vertical axis, in combination with reversing means for reversing the direction of spray head rotation in an oscillatory manner back and forth motion between adjustably set end limits or stops to sweep the water stream over an arcuate part-circle terrain area. In many sprinkler designs, the spray head is mounted at the upper end of a pop-up riser for movement between an elevated spraying position with the spray head raised above the sprinkler housing when a main system water supply is turned on, and a spring-retracted position concealed substantially within the sprinkler housing when the main system water supply is turned off. In a typical irrigation system, a common water supply conduit is coupled to multiple sprinkler devices installed within a prescribed terrain area to be irrigated, and a main control valve is turned on and off manually or by automated means for regulating water supply to the sprinkler devices.

For examples of rotary drive pop-up sprinklers of the abovedescribed general type, see U.S. Pat. Nos. 4,625,914 and 4,787,558. In addition, such rotary drive pop-up sprinklers are commercially available from Rain Bird Sprinkler Mfg. Corp. of Glendora, Calif. under the product designations T-Bird Series, R-50, Falcon, and Talon.

In many such sprinkler devices, the at least one spray nozzle mounted on the spray head is removable to accommodate installation of a selected one of a group of spray nozzles adapted to deliver irrigation water to the surrounding terrain with different spray pattern and/or flow rate or flow trajectory characteristics. Accordingly, the multiple sprinkler devices in an irrigation system can be equipped with different spray nozzles to provide a customized pattern of irrigation water delivery to the associated vegetation. As the vegetation matures, or upon replacing some or all of the plants with different vegetation, the spray nozzles associated with one or more of the sprinkler devices can be changed quickly and easily to modify the customized irrigation delivery pattern. In addition, other periodic adjustments to the sprinkler devices may be necessary or desirable, such as adjusting the reversing end limits or stops for one or more of the sprinkler devices.

In the past, sprinkler device adjustments have normally been performed while the main water supply system is turned off. For spray nozzle removal and replacement, particularly with a pop-up type sprinkler, this requires the service person to manually grasp and lift the spring-loaded riser in order to access the spray head, and then manually hold the riser in the elevated position with one hand while attempting to remove and replace the spray nozzle with the other hand. Such manipulation of the spring-loaded riser can be difficult. After the spray nozzle has been replaced, it is then necessary for the service person to access the main control valve which is often located at a remote site to turn on the water supply, and then return to the adjusted sprinkler to inspect and confirm proper operation. Such back-and-forth movement is inconvenient and time-consuming.

Some sprinkler devices have been equipped with internal flow shutoff valves to permit interruption of the water supply to the individual spray head, thereby permitting spray nozzle removal and replacement without requiring the main system water supply to be turned off. See, for example, U.S. Pat. No. 5,762,270. The inclusion of such internal shut-off valve beneficially allows the irrigation water under pressure to be supplied to the sprinkler device for displacing the pop-up riser and the spray head thereon to the elevated spraying position where the spray nozzle is readily accessible, but interrupts water flow to the spray head for convenient spray nozzle removal. Additional sprinkler adjustments such as adjustably setting the reversing end limits or stops may also be performed, all without unreasonably drenching the service person and further without requiring the service person to travel back-and-forth to the main control valve.

However, such internal shut-off valves mounted within sprinkler devices have in the past required several turns of a valve actuator in order to turn the valve on and off, thereby exposing the service person to some irrigation spray during each off-on and on-off actuation interval. Moreover, in the normal open position, such shut-off valves have presented at least some water flow obstruction and resultant pressure drop at the upstream side of the spray nozzle. This pressure drop undesirably results in a reduced maximum water flow rate through the spray nozzle.

The present invention overcomes these problems and disadvantages by providing an improved gate valve mounted within a sprinkler spray head at the upstream side of a spray nozzle for quick and easy part-turn movement between a normal open position for substantially unobstructed water flow to and through the nozzle, and a closed position shutting off the water flow to the nozzle to accommodate facilitated nozzle removal and/or replacement or other sprinkler adjustments.

SUMMARY OF THE INVENTION

In accordance with the invention, an irrigation sprinkler includes an improved nozzle gate valve for quick and easy shut-off of water flow to a sprinkler spray nozzle. The gate valve is mounted within a sprinkler spray head at an upstream side of the spray nozzle for displacement between open and closed positions respectively permitting and preventing water flow to the nozzle. An actuator pin is exposed at the top of the spray head and is adapted for part-turn movement to displace the gate valve between the open and closed positions. In the closed position, the spray nozzle can be removed and/or replaced, or other sprinkler adjustments can be performed, without requiring a main system water supply to be turned off.

In the preferred form, the gate valve has a generally conical shape seated within a matingly shaped valve pocket or chamber formed in the spray head at the upstream side of the spray nozzle. The conical gate valve defines an elbow-shaped flow path movable between the open position aligned with the spray nozzle for normal water supply thereto, and the closed position misaligned with the spray nozzle to prevent water flow thereto. The actuator pin at the top of the spray head is rotatable through a part-circle stroke of about 180° for displacing the gate valve between the open and closed positions. In the closed position, water under pressure supplied to the sprinkler urges the gate valve into pressure-activated sealing relation with the spray head to positively seal against waterflow to the spray nozzle. The gate valve may include internal directional flow vanes formed within the elbow-shaped flow path for smooth water flow transition to the spray nozzle, when said gate valve is in the open position.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
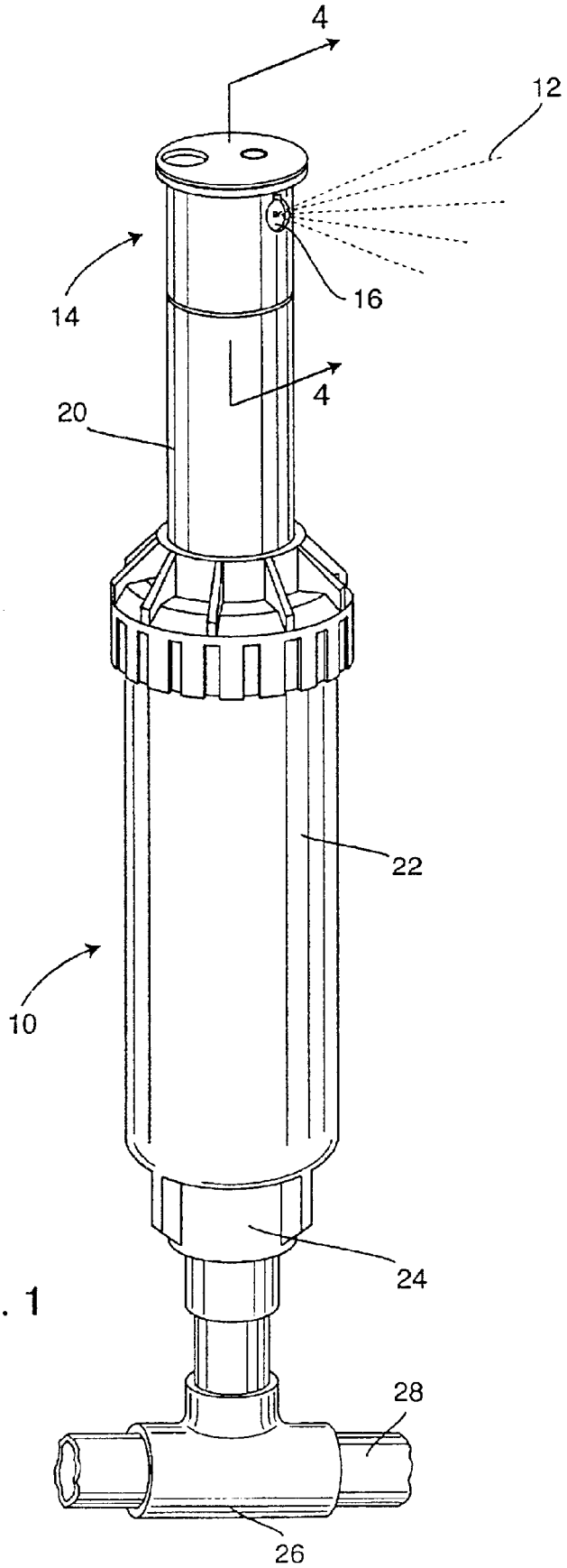
FIG. 1 is a perspective view of a rotary drive pop-up sprinkler adapted to include a nozzle gate valve mounted in accordance with the present invention within a sprinkler spray head.

As shown in the exemplary drawings, an irrigation sprinkler referred to generally in FIG. 1 by the reference numeral 10 is provided for delivering a stream or spray 12 of irrigation water over a surrounding terrain area to irrigate vegetation. The sprinkler 10 includes a spray head 14 equipped with at least one removable spray nozzle 16 so that the pattern and flow rate of the projected water stream 12 can be custom-selected to suit the particular irrigation requirements. A gate valve 18 (FIGS. 2–5) is mounted within the spray head 14 for quickly and easily shutting off the water flow to the spray nozzle 16 to facilitate nozzle removal and/or replacement as well as other sprinkler adjustments, without requiring a main system water supply to be turned off.

The illustrative irrigation sprinkler 10 is shown in the form of a pop-up rotary drive sprinkler wherein the spray head 14 is mounted at an upper end of a pop-up riser 20. More particularly, the sprinkler 10 is shown in FIG. 1 to include a lower sprinkler housing 22 having an inlet fitting 24 as a lower end thereof for connection via a tee coupling 26 or the like to a main water supply conduit 28. The riser 20 comprises a generally tubular structure which is conventionally spring-loaded for normal retraction of the spray head 14 to a position (not shown) substantially concealed within the sprinkler housing 22. The riser 20 responds to the supply of irrigation water under pressure to the interior of the housing 22 to shift upwardly to an elevated spraying position (as viewed in FIG. 1), with the spray head 14 and associated spray nozzle 16 spaced upwardly above the top of the housing 22. A rotary drive mechanism (not shown) is incorporated within the sprinkler housing 22 and/or the riser 20 for rotatably driving the spray head 14 in a manner to sweep the projected water stream 12 over the surrounding terrain area. This rotary drive mechanism may be associated with a reverse mechanism (also not shown) for reversibly shifting the direction of spray head rotation for back and forth part-circle rotation between adjustably set end limits or stops, to sweep the projected water stream 12 through a predetermined part-circle arcuate pattern. For examples of rotary drive pop-up sprinklers of this general type, see U.S. Pat. Nos. 3,107,056; 3,724,757; 4,568,024; 4,718,605; 4,787,558; and 5,383,600, which are incorporated by reference herein. In addition, such sprinklers are commercially available from Rain Bird Sprinkler Mfg. Corp. of Glendora, Calif. under the product designations T-Bird Series, 3500 Series, R-50 Series, Falcon, and Talon.

The irrigation sprinkler 10 as shown generally in FIG. 1 is normally coupled via the main water supply conduit 28 with a plurality of additional sprinkler devices in a common irrigation field or zone, with the multiple sprinklers being supplied with water under pressure upon opening of a main control valve (not shown) located typically at a convenient and sometimes remote location. Each of the multiple sprinklers of the irrigation system desirably includes the gate valve 18 of the present invention to permit individual interruption of the water flow to the associated spray nozzle 16, whereby removal and/or replacement of the spray nozzle and other sprinkler adjustments such are adjusting the reversing end stops are facilitated without requiring the main system water supply to be turned off by closing the main control valve.

Figure 2:
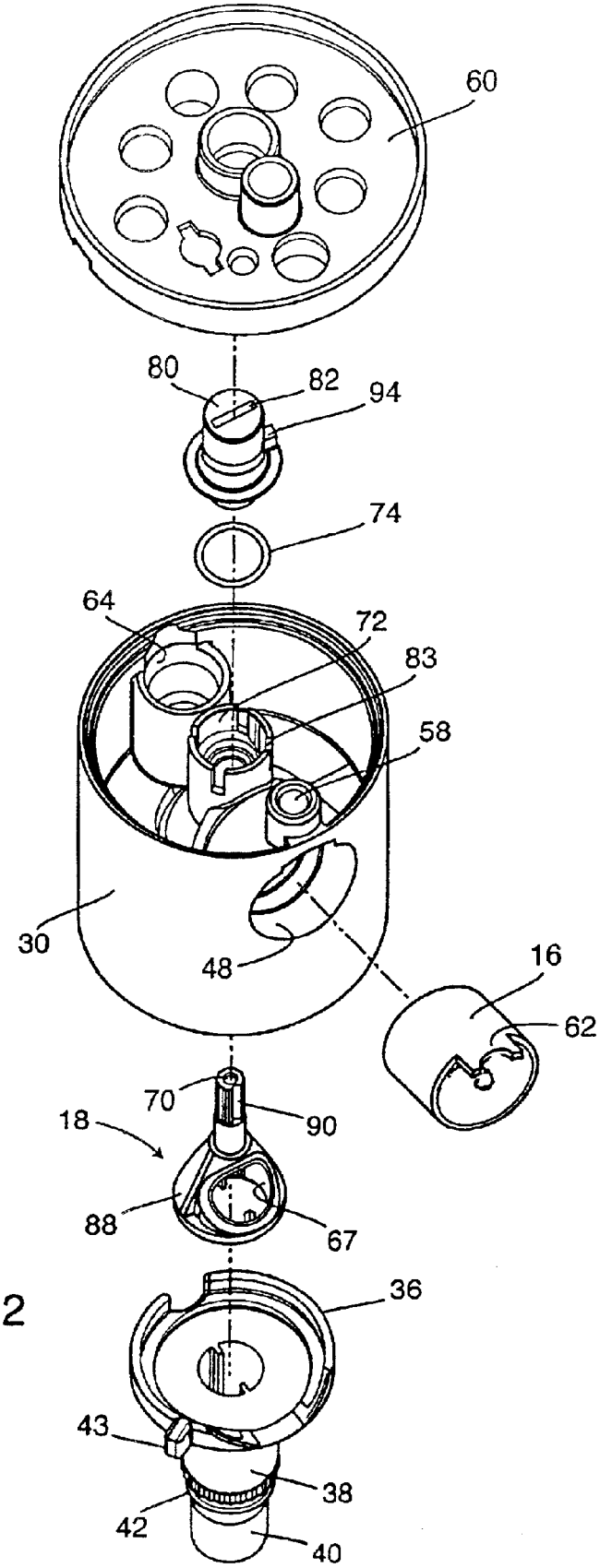
FIG. 2 is an enlarged exploded top perspective view showing the sprinkler spray head of FIG. 1, and illustrating the nozzle gate valve.
Figure 3:
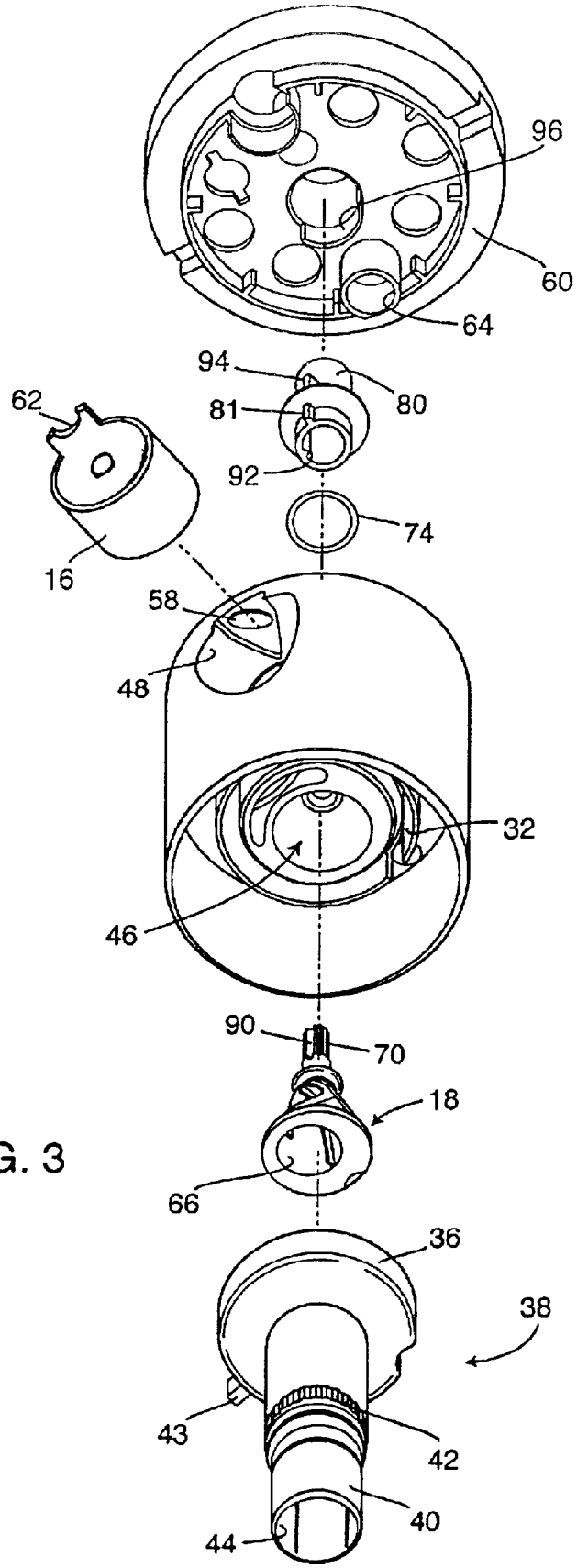
FIG. 3 is an enlarged exploded bottom perspective view showing the spray head of FIGS. 1 and 2, and illustrating the nozzle gate valve.

As shown in detail in FIGS. 2–5, the illustrative spray head 14 comprises an upper turret 30 of generally cylindrical shape mounted at the upper end the tubular riser 20. The upper turret 30 may be conveniently molded from a suitable lightweight plastic or the like, and includes an internal valve case 32 molded integrally therein with a lower marginal end 34 (FIGS. 4–5) adapted for connection as by sonic welding or the like to a matingly shaped upper rim 36 of a lower turret 38 which may also be molded from a lightweight plastic material. This lower turret 38 includes a downwardly projecting tubular stem 40 mounted coaxially within the riser 20 and adapted to be rotatably driven by the rotary drive mechanism (not shown) of the pop-up rotary drive sprinkler 10. In this regard, FIGS. 2–3 show the lower turret stem 40 with an annular tooth pattern 42 for drive engagement by the rotary drive mechanism, as well as a radially outwardly extending tab 43 for indexing the lower turret 38 with the upper turret 30.

The lower turret 38 has an open bore passage 44 formed therein and defining a portion of a water flow passage for flow of water upwardly from within the sprinkler housing 22 to the spray nozzle, when the main system water supply is turned on. This upward water flow passes into a valve chamber 46 defined cooperatively by the valve case 32 and the upper rim 36 of the lower turret 38. The gate valve 18 of the present invention is installed within this valve chamber 46 to regulate water flow further to a radially outwardly open and typically upwardly inclined nozzle bore 48 having the spray nozzle 16 mounted removably therein. In this regard, the spray nozzle 16 typically has generally cylindrical configuration with a contoured nozzle passage 50 formed therein, wherein this nozzle passage 50 commonly includes a rapidly converging upstream end segment which merges into a narrower downstream spray segment of selected cross sectional size and shape.

Figure 4:
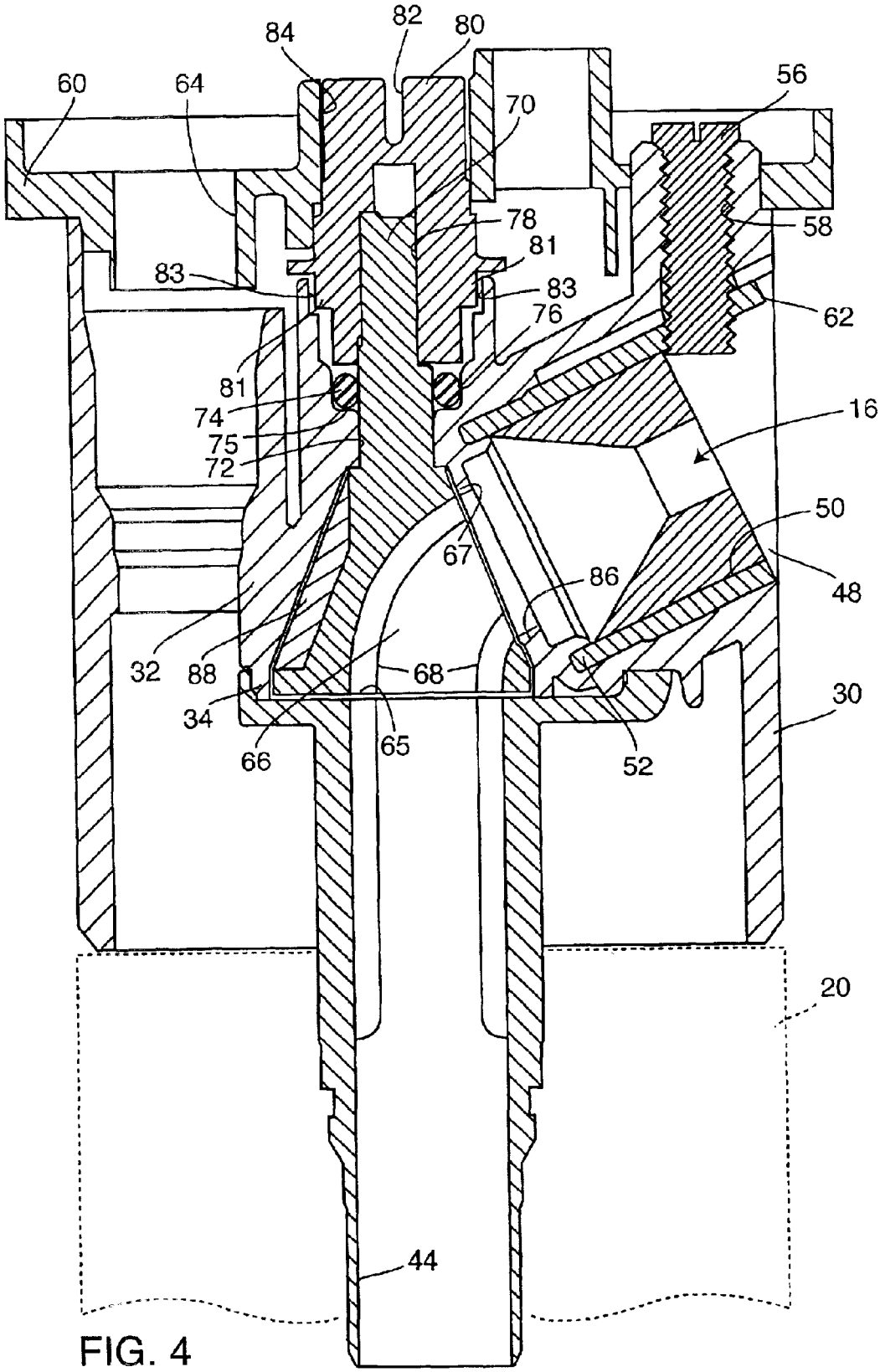
FIG. 4 is an enlarged fragmented vertical sectional view taken generally on the line 4—4 of FIG. 1, and showing the nozzle gate valve in an open position.
Figure 5:
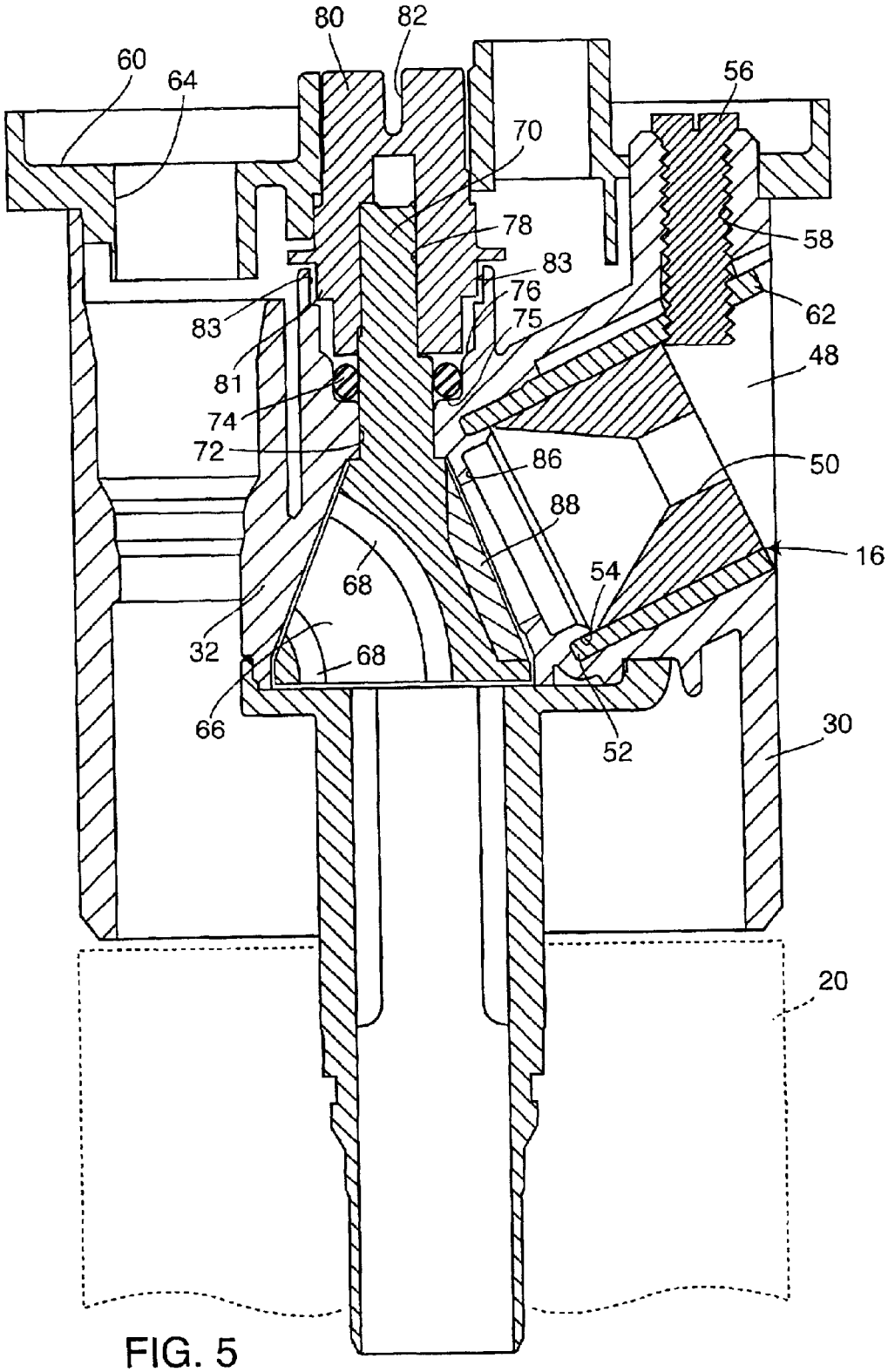
FIG. 5 is an enlarged fragmented vertical sectional view similar to FIG. 4, but depicting the nozzle gate valve in a closed position.

The specific geometric size and shape of the nozzle passage 50 in the spray nozzle 16 may vary among a group of spray nozzles adapted for interchangeable mounting on the spray head 14 to permit individual selection of the flow rate, trajectory, and spray pattern of the water stream 12 (FIG. 1) projected from each sprinkler 10. FIGS. 4–5 show a selected spray nozzle 16 in an installed position with a rear annular margin 52 thereof seated within a shallow annular groove 54 formed at the base of the nozzle bore 48. The spray nozzle 16 is removably captured or retained in this seated position by a set screw 56 (see FIG. 4) adapted to protrude downwardly through a threaded bore 58 in a turret cap 60 to a position in front of a protruding tab or ear 62 at a front margin of the spray nozzle 16. The turret cap 60 is mounted onto an upper end of the upper turret 30 as by sonic welding, or by other suitable means such as one or more screws (not shown), and may incorporate one or more additional ports or passages formed therein for accessing and/or adjusting other sprinkler mechanisms such as a port 64 for receiving and supporting a reverse stop adjustment screw (not shown).

The valve chamber 46 formed cooperatively by the valve case 32 and the underlying rim 36 of the lower turret 38 has, in the preferred form, a generally conical shape for relatively close fit and mating reception of a conically shaped gate valve 18. This gate valve 18 has a generally circular bottom profile or footprint seated on the lower turret rim 36, and extends upwardly therefrom with a radially inwardly sloping side profile. An internal and generally elbow-shaped flow path 66 is formed in the conical body of the gate valve 18 and extends from an inlet 65 formed in the bottom or base of the gate valve to an outlet 67 formed to open through the conical side wall of the gate valve. This elbow-shaped flow path 66 guides water flow upwardly from the lower turret stem 40 and then smoothly turns the water flow radially with an inclination angle for generally coaxial flow to and through the associated spray nozzle 16. Internal longitudinally extending flow guide vanes and ribs 68 are conveniently provided to extend longitudinally within this elbow-shaped flow path 66 for smoothly transitioning the water flow direction with minimal pressure loss and minimal flow turbulence, and substantially without throttling or choking or otherwise obstructing the water flow.

In accordance with invention, the gate valve 18 is rotatable within the valve chamber 46 between an open position for supplying the water flow from the lower turret 38 to the spray nozzle 16, and a closed position interrupting or shutting off that water flow. In this regard, an upper or apex end of the conical gate valve 18 is joined as by integral molding to an upwardly extending valve stem 70 which protrudes upwardly through an aperture 72 at the top of the valve case 32 to a position generally at the underside of the turret cap 60. A seal ring such as an O-ring seal 74 or the like is carried about the valve stem pin 70 in engagement with an annular shoulder 75 formed on the lower portion of a cylindrical shaped wall 76 on the valve case 32 for sealing the aperture 72 against water leakage. An upper end of the valve stem 70 is externally splined (FIGS. 2–3) and is press-fit received into a hollow counterbore 78 at the underside of an actuator pin 80 having a slotted upper end 82 exposed through a port 84 formed in the turret cap 60.

Accordingly, the slotted upper end of the actuator pin 80 is exposed for engagement by a conventional screwdriver blade (not shown) or the like for rotary movement to rotatably displace the gate valve 18 within the valve chamber 46 to a normal open position as viewed in FIG. 4, with the elbow-shaped flow path 66 of the gate valve 18 aligned with the spray nozzle 16 for supplying water thereto. Alternately, the actuator pin 80 can be rotated quickly and easily by means of the screwdriver or the like to rotate the gate valve 18 through a displacement of up to about 1800 to the closed position, with a downstream end of the gate valve flow path 66 misaligned with the spray nozzle 16 as viewed in FIG. 6 to interrupt or shut off water flow thereto. In this closed position, water under pressure within the lower turret 38 presses upwardly against the underside of the gate valve 18 to urge the conical gate valve surface into firm pressure-activated sealing relation with an annular seal lip 86 formed at an upstream end of the nozzle bore 48. In addition, enhanced sealing engagement between the gate valve 18 and the seal lip 86 may be obtained by providing a resilient seal coating 88 applied as by overmolding or the like onto the conical surface of the gate valve in surrounding relation to the outlet 67 formed therein.

For accurate rotational displacement of the gate valve between the open and closed positions, the valve stem 70 may include a slotted keyway 90 for slide-ft reception of an internal key 92 on the actuator pin 80. This structure insures assembly of the actuator pin 80 with the valve stem 70 in a predetermined position of rotational alignment. A radially outwardly protruding stop tab 94 on the actuator pin 80 is thus positioned circumferentially between the end edges of a half-circle arcuately shaped skirt 96 (FIG. 3) depending from the underside of the turret cap 60. With this arrangement, the actuator pin 80 is rotatably movable through an arcuate stroke of about 180°, with abutment of the stop key 94 against the opposite end edges of the skirt 96 respectively positioning the gate valve 18 in the open and closed positions. Interengageable flexible detents coacting between the actuator pin 80 and the inner surface of the valve case sleeve wall 76 may also be provided to yield tactile and audible feedback indicative of gate valve displacement to the open and closed positions, respectively. In this instance, the detents are formed by a pair-of dramatically opposed grooves 83 in the wall of the upper end portion of the valve sleeve wall 76 above the O-ring 74, and a correspondingly located pair of generally rectangular tabs 81 on the outer surface of the lower portion of the actuator pin 80. Rotation of the actuator pin 80 causes the tabs 81 to flex out of the grooves 83 until the tabs again snap into the opposite grooves upon opening and/or closing. In this way, both a tactile and an audible "click" is produced, thereby to indicate that the cone valve 18 is fully open or closed.

In use, the gate valve 18 is normally set in the open position (FIG. 4) with the flow path 66 there through in full alignment at the upstream side with the lower turret bore 44, and in full alignment at the downstream side with the spay nozzle 16. With this geometry, the flow of water is substantially unobstructed from the interior of the sprinkler housing 22 upwardly through the lower turret 38, and further through the gate valve flow path 66 to and through the associated spray nozzle 16. Such water flow occurs, of course, whenever the main water supply system is turned on. Importantly, if and when an adjustment to the sprinkler 10 is desired, such as removal and replacement of the spray nozzle 16, the gate valve 18 can be quickly and easily shifted to the closed position (FIG. 5) with a simple part-turn or half-turn motion of the actuator pin ;80 as described above to shut off water flow to the spray nozzle for that individual sprinkler, without requiring the main system water supply to be turned off. Upon completion of the desired adjustments, the gate valve 18 can be quickly and easily shifted back to the open position with a reverse part-turn motion for resumed normal sprinkler operation.

Figure 7:
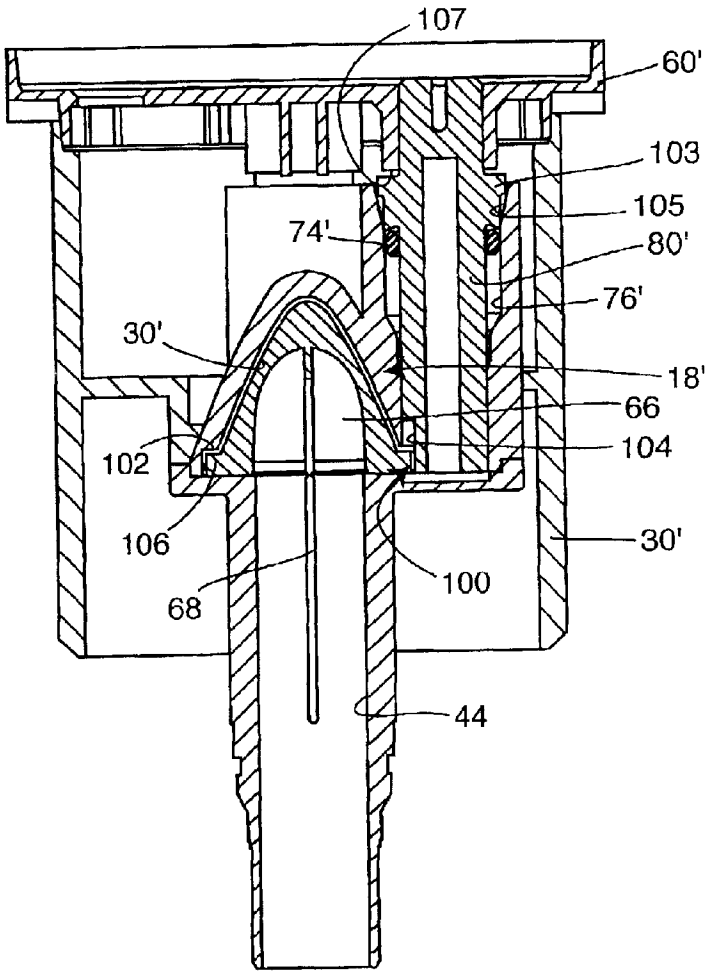
FIG. 7 is a vertical sectional view taken substantially along the line 7—7 of FIG. 6.
Figure 6:
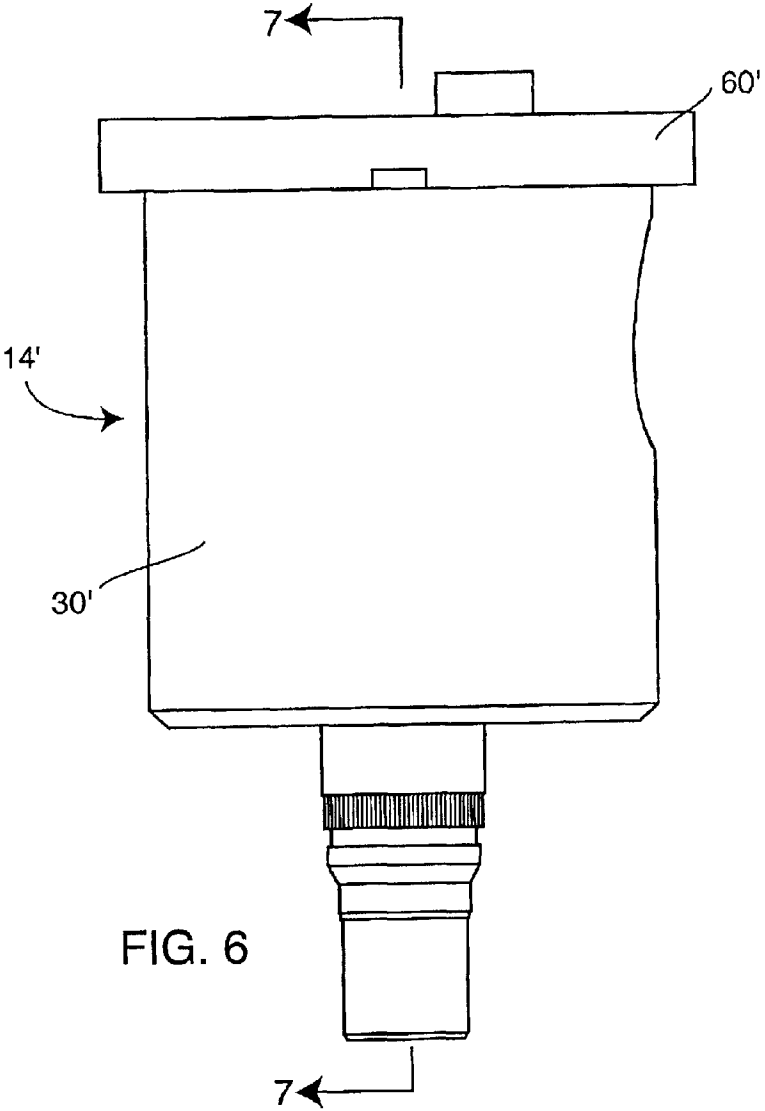
FIG. 6 is an enlarged perspective view of a spray head incorporating a modified form of the gate valve and actuator therefor.
Figure 8:
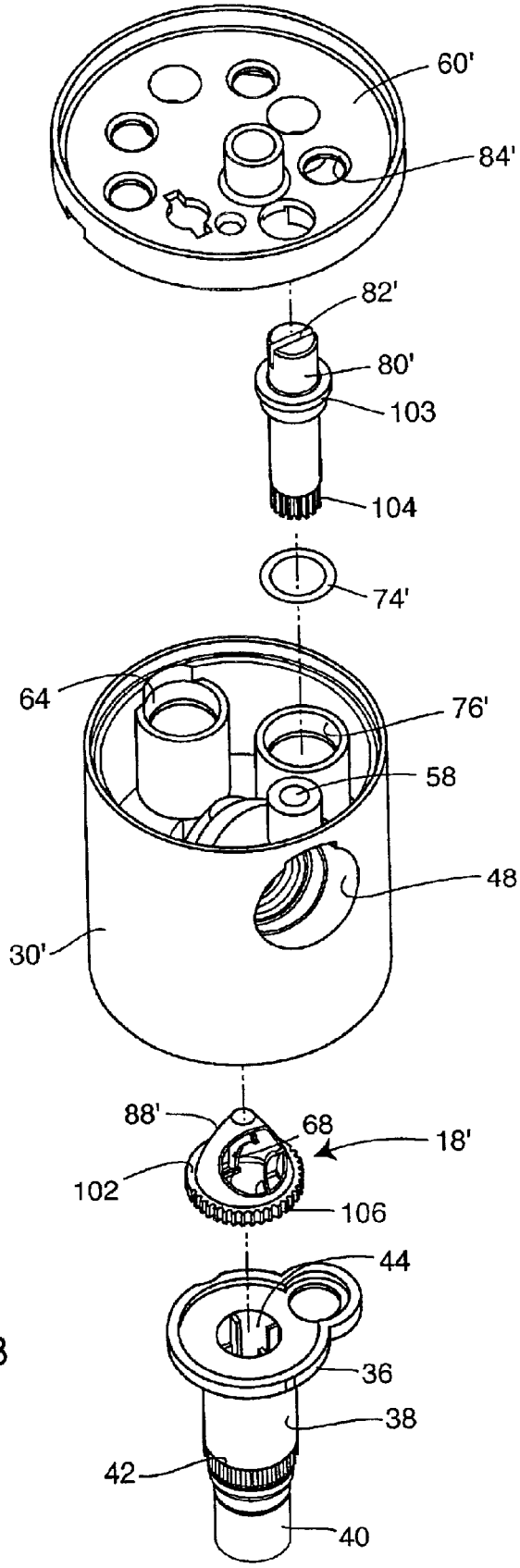
FIG. 8 is an exploded top perspective view similar to the exploded view of FIG. 2, but showing the modified gate valve and actuator of the embodiment of FIG. 6.

FIGS. 6–8 show an alternative embodiment of the present invention wherein the gate valve 18' is actuated by a gear-type coupling, generally designated 100 in FIGS. 7 and 8, formed between the lower end of a modified actuator pin 80', and a portion of the outer peripheral edge formed by a radially extending flange 102 at the lower end of the gate valve. As will be readily apparent from the following, the function and operation of the gate valve 80' is substantially the same as that of the embodiment of FIGS. 1–5, and only the structure for operating the gate valve from outside the sprinkler is different. For purposes of discussion herein, parts which generally correspond in structure and/or function to parts described in connection with the presently preferred embodiment of FIGS. 1–5, are designated in FIGS. 6–8 with corresponding primed reference numerals.

In this instance, as best seen in FIGS. 7 and 8, the actuator pin 80' is disposed to be off-set from the centerline of the sprinkler, and is rotatably mounted to the spray head 14' through the upper turret 30', herein by a radially enlarged flange 103 received in an enlarged wall portion 105 of a bore 76' formed in the upper turret to extend along one side of the upper turret centerline. The actuator pin 80' terminates at its lower end adjacent the outer peripheral edge of the flange 102 of the gate valve 18'. The upper end of the actuator pin 80' projects through a cylindrical opening or port 84' formed in the turret cap 60' so as to be accessible from the outside of the sprinkler 10. As best seen in FIG. 7, the actuator pin 80' is retained in position in the spray head 14' by a cylindrical shoulder 107 formed by the lower end of the cylindrical port 84' which abuts the upper side of the flange 103 of the actuator pin.

The cylindrical lower end of the actuator pin 80' is formed with teeth 104 which are adapted to mate with teeth 106 formed around a portion of the outer peripheral edge of the flange 102 of the gate valve 80'. Herein, the teeth 106 are formed to extend 180 degrees around the peripheral edge of the flange 102 so that when the actuator pin 80' is rotated, the gear-type coupling 100 will cause the gate valve 80' to rotate though an arc of 180 degrees between the fully open and fully closed positions, thereby to displace the gate valve from the open to closed position, and vice-versa. Since the teeth 106 extend only 180 degrees around the periphery of the gate valve 18', when the actuator pin 80' has reached the fully open or closed positions, the actuator pin can not be rotated as it will bind against the untoothed portion of the gate valve flange 102, thereby acting as a detent-like stop to prevent further gate valve rotation, and providing a tactile indication that the gate valve has reached the fully open or closed position.

A wide variety of further modifications and improvements in and to the improved irrigation sprinkler and associated gate valve of the present invention will be apparent to those persons skilled in the art. For example, it will be recognized and appreciated that the gate valve may be rotated to a partially closed position in the event that partial throttling of the water flow to the spray nozzle is desired. Accordingly, no limitation on the invention is intended by way of the foregoing description, except as set forth in the appended claims.

What is claimed is:

1. In an irrigation sprinkler having a sprinkler housing defining a flow passage for coupling a supply of water under pressure to a spray head having at least one spray nozzle mounted thereon for projecting the water outwardly from the sprinkler, the improvement comprising:

a gate valve mounted along the flow passage at an upstream side of the spray nozzle, said gate valve being movable between an open position permitting substantially unobstructed water flow to said spray nozzle and a closed position preventing water flow to said spray nozzle;

said gate valve defining an inlet, an outlet, and a flow path extending therein between said inlet and said outlet, said gate valve being rotatably supported within a valve chamber formed in said spray head at an upstream side of said spray nozzle; and an actuator mounted to said spray head and coupled to said gate valve for displacing said gate valve between said open position with said flow path aligned with said spray nozzle, and said closed position with said flow path misaligned with said spray nozzle.

2. The irrigation sprinkler of claim 1 wherein said flow path formed in said gate valve has a generally elbow-shaped configuration.

3. The irrigation sprinkler of claim 2 wherein said gate valve further includes at least one flow guide vane extending longitudinally along said elbow-shaped flow path.

4. The irrigation sprinkler of claim 2 wherein said gate valve is rotatable between said open position with a downstream end of said elbow-shaped flow path aligned with said spray nozzle, and said closed position with said downstream end of said elbow-shaped flow path misaligned with said spray nozzle.

5. The irrigation sprinkler of claim 1 wherein said actuator comprises a pin rotatably mounted to said spray head for rotatably displacing said gate valve between said open and closed positions.

6. The irrigation sprinkler of claim 5 wherein said actuator pin is rotatably mounted within a generally cylindrical shaped opening through said spray head, and flexible detent means are formed between said actuator pin and said generally cylindrical shaped opening to provide an indication that said gate valve has been fully displaced to said open or closed position.

7. The irrigation sprinkler of claim 1 wherein said actuator comprises an elongated pin rotatably mounted to said spray head and which is accessible from the exterior of said sprinkler.

8. The irrigation sprinkler of claim 1 wherein said at least one spray nozzle is removably mounted on said spray head.

9. The irrigation sprinkler of claim 1 wherein the spray head is mounted at an upper end of a pop-up riser adapted to extend upwardly from the sprinkler housing upon coupling of the sprinkler housing to the supply of water under pressure.

10. The irrigation sprinkler of claim 1 wherein said gate valve has a generally conical shape defining said inlet formed in a base thereof, said outlet formed in a conical side wall thereof, and said flow path having a generally elbow-shaped configuration extending from said inlet to said outlet, said conical gate valve being rotatably supported within said valve chamber having a generally matingly shaped configuration formed in said spray head at an upstream side of said spray nozzle, said actuator being accessible from the exterior of said sprinkler for rotatably displacing said conical gate valve between said open position with said outlet at a downstream end of said elbow-shaped flow path aligned with said spray nozzle, and said closed position with said outlet misaligned with said spray nozzle.

11. The irrigation sprinkler of claim 10 wherein said actuator comprises an elongated pin rotatably mounted within a generally cylindrical shaped opening through said spray head, and detent means are formed between said actuator pin and said generally cylindrical shaped opening to provide tactile feedback when said gate valve is displaced to said fully open and closed positions.

12. The irrigation sprinkler of claim 10 further including a valve stem extending upwardly from an apex end of said conical gate valve, said actuator being coupled to said valve stem for rotatably displacing said gate valve between said open and closed positions.

13. The irrigation sprinkler of claim 12 wherein said actuator comprises an actuator pin rotatably mounted to said spray head and having an externally exposed slotted upper end.

14. The irrigation sprinkler of claim 12 wherein said actuator further includes means for limiting rotational displacement of said gate valve to part-circle back-and-forth movement between said open and closed positions.

15. The irrigation sprinkler of claim 14 wherein said rotational displacement limiting means restricts gate valve rotation to a rotational stroke of about 180 degrees.

16. The irrigation sprinkler of claim 11 wherein said actuator pin is rotatably mounted within a generally cylindrical shaped opening through said spray head, and said detent means are flexible and formed between said actuator pin and said generally cylindrical shaped opening to provide an audible sound when said gate valve is displaced to said open and closed positions.

17. The irrigation sprinkler of claim 11 wherein said actuator pin is rotatably mounted within a generally cylindrical shaped opening through said spray head, and said detent means are flexible and formed between said actuator pin and said generally cylindrical shaped opening to provide tactile feedback when said gate valve is displaced to said open and closed positions.

18. The irrigation sprinkler of claim 11 wherein said actuator pin is rotatably mounted within a generally cylindrical shaped opening through said spray head, and said detent means are formed between said actuator pin and said gate valve and provides tactile feedback when said gate valve is displaced to said fully open and closed positions.

19. The irrigation sprinkler of claim 10 wherein said conical side wall of said gate valve has a seal coating thereon.

20. The irrigation sprinkler of claim 10 wherein said spray head further includes a seal lip for pressure-activated sealing engagement by said gate valve when said gate valve is in said closed position.

21. The irrigation sprinkler of claim 10 wherein said gate valve further includes at least one flow guide vane extending longitudinally along said elbow-shaped flow path.

22. An irrigation sprinkler, comprising:

a sprinkler housing adapted for connection to a supply of water under pressure, said sprinkler housing including a pop-up riser having a spray head at an upper end thereof, and at least one spray nozzle removably mounted on said spray head for projecting water outwardly from the sprinkler;

a gate valve mounted on said spray head at an upstream side of said spray nozzle, said gate valve being movable between an open position permitting substantially unobstructed water flow to said spray nozzle and a closed position preventing water flow to said spray nozzle;

said gate valve defining an inlet, an outlet, and a flow path extending therein between said inlet and said outlet, said gate valve being rotatably supported within a valve chamber formed in said spray head at an upstream side of said spray nozzle; and an actuator mounted to said spray head and coupled to said gate valve for displacing said gate valve between said open position with said flow path aligned with said spray nozzle, and said closed position with said flow path misaligned with said spray nozzle.

23. The irrigation sprinkler of claim 22 wherein said flow path formed in said gate valve has a generally elbow-shaped configuration, said gate valve being rotatable between said open position with a downstream end of said elbow-shaped flow path aligned with said spray nozzle, and said closed position with said downstream end of said elbow-shaped flow path misaligned with said spray nozzle.

24. The irrigation sprinkler of claim 23 wherein said gate valve further includes at least one flow guide vane extending longitudinally along said elbow-shaped flow path.

25. The irrigation sprinkler of claim 23 wherein said gate valve has a generally conical shape defining said inlet formed in a base thereof, said outlet formed in a conical side wall thereof, and said flow path having a generally elbow-shaped configuration extending from said inlet to said outlet, said conical gate valve being rotatably supported within said valve chamber having a generally matingly shaped configuration formed in said spray head at an upstream side of said spray nozzle.

26. The irrigation sprinkler of claim 25 further including a valve stem extending upwardly from an apex end of said conical gate valve, said actuator means being coupled to said valve stem for rotatably displacing said gate valve between said open and closed positions.

27. The irrigation sprinkler of claim 26 wherein said actuator comprises an actuator pin accessible from the exterior of said sprinkler and having an externally exposed slotted upper end.

28. The irrigation sprinkler of claim 27 wherein said actuator means further includes means for limiting rotational displacement of said gate valve to part-circle back-and-forth movement between said open and closed positions.

29. The irrigation sprinkler of claim 28 wherein said actuator pin is rotatably mounted within a generally cylindrical shaped opening through said spray head, and flexible detent means are formed between said actuator pin and said generally cylindrical shaped opening to provide an audible sound when said gate valve is displaced to said open and closed positions.

30. The irrigation sprinkler of claim 29 wherein said rotational displacement limiting means restricts gate valve rotation to a rotational stroke of about 180°.

31. The irrigation sprinkler of claim 30 wherein said conical side wall of said gate valve has a seal coating thereon.

32. The irrigation sprinkler of claim 31 wherein said spray head further includes a seal lip for pressure-activated sealing engagement by said gate valve when said gate valve is in said closed position.

33. In an irrigation sprinkler having a sprinkler housing defining a flow passage for coupling a supply of water under pressure to a spray head having at least one spray nozzle mounted thereon for projecting the water outwardly from the sprinkler, the improvement comprising:

a gate valve mounted along the flow passage at an upstream side of the spray nozzle, said gate valve being movable between an open position permitting substantially unobstructed water flow to said spray nozzle and a closed position preventing water flow to said spray nozzle;

said gate valve defining an inlet, an outlet, and a flow path extending therein between said inlet and said outlet, said gate valve being rotatably supported within a valve chamber formed in said spray head at an upstream side of said spray nozzle; and an actuator pin rotatably mounted to said spray head and coupled to said gate valve for displacing said gate valve between said open position with said flow path aligned with said spray nozzle, and said closed position with said flow path misaligned with said spray nozzle.

34. The irrigation sprinkler of claim 33 wherein said actuator pin is rotatably mounted within a generally cylindrical shaped opening through said spray head and off-set from the centerline thereof, and said actuator pin has upper and lower ends, said lower end being rotatably coupled to said gate valve and said upper end being accessible from the exterior of said sprinkler.

35. The irrigation sprinkler of claim 34 wherein said actuator pin has teeth around the periphery of said lower end, and said gate valve has an enlarged flange adjacent its lower end, said flange having teeth formed around a portion of the periphery thereof and engaged with said teeth of said actuator pin.

36. The irrigation sprinkler of claim 35 wherein said teeth formed on said flange of said gate valve extend 180 degrees around the periphery thereof, whereby rotation of said actuator pin can displace said gate valve 180 degrees between said fully open and closed positions.

37. The irrigation sprinkler of claim 36 further including stop means for limiting displacement of said gate valve, said stop means providing tactile feedback to indicate when said gate valve is in the fully open and closed positions.

* * * * *

US006802458C1

(12) EX PARTE REEXAMINATION CERTIFICATE (7548th)

United States Patent
Gregory

(10) Number: US 6,802,458 C1
(45) Certificate Issued: Jun. 1, 2010

(54) SPRINKLER WITH NOZZLE GATE VALVE

(75) Inventor: Christian T. Gregory, La Crescenta, CA (US)

(73) Assignee: Rain Bird Corporation, Glendora, CA (US)

Reexamination Request:
No. 90/008,563, Mar. 30, 2007

Reexamination Certificate for:

| | |
|---|---|
| Patent No.: | **6,802,458** |
| Issued: | **Oct. 12, 2004** |
| Appl. No.: | **10/079,469** |
| Filed: | **Feb. 21, 2002** |

(51) Int. Cl.
*B05B 15/10* (2006.01)

(52) U.S. Cl. ..... 239/205; 239/242; 239/580

(58) Field of Classification Search ..... 239/205

See application file for complete search history.

(56) References Cited

U.S. PATENT DOCUMENTS

| | | | | | |
|---|---|---|---|---|---|
| 4,729,511 | A | * | 3/1988 | Citron | 239/205 |
| 5,226,599 | A | * | 7/1993 | Lindermeir et al. | 239/205 |
| 6,085,995 | A | * | 7/2000 | Kah et al. | 239/237 |
| 2002/0074432 | A1 | * | 6/2002 | Kah et al. | 239/443 |

* cited by examiner

*Primary Examiner*—Aaron J. Lewis

(57) ABSTRACT

A nozzle gate valve is provided in an irrigation sprinkler for quick and easy shut-off of water flow to a sprinkler spray nozzle. The gate valve is mounted within a sprinkler spray head at an upstream side of the nozzle for displacement between open and closed positions respectively permitting and preventing waterflow to the nozzle. In the preferred form, the gate valve has a generally conical shape and defines an elbow-shaped flow path movable between the open position aligned with the nozzle for normal water supply thereto, and the closed position misaligned with the spray nozzle to prevent water flow thereto. In the closed position, the spray nozzle can be removed and/or replaced, or other sprinkler adjustments can be performed, without requiring a main system water supply to be turned off.

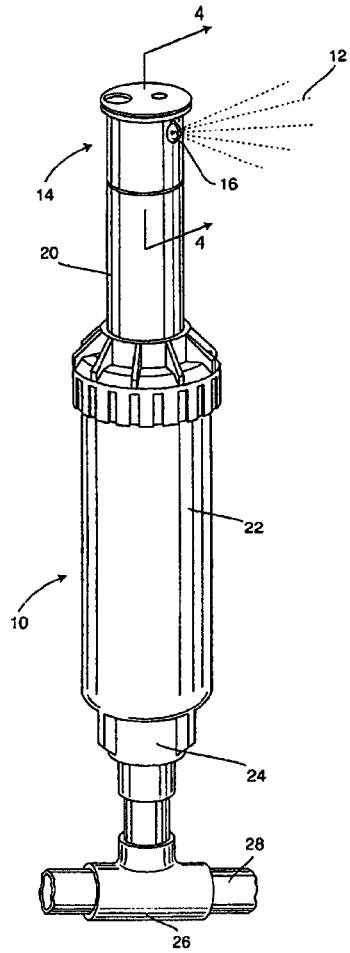

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 8, 11, 22-27 and 33-35 are cancelled.

Claims 2, 4, 5, 7, 9, 10, 14, 15-20, 28, 29 and 36 are determined to be patentable as amended.

Claims 3, 6, 12, 13, 21, 30-32 and 37, dependent on an amended claim, are determined to be patentable.

New claim 38 is added and determined to be patentable.

2. [The irrigation sprinkler of claim 1] *An irrigation sprinkler comprising:*

*a sprinkler housing defining a flow passage for coupling a supply of water under pressure to a spray head having at least one removable spray nozzle mounted on said spray head for projecting water outwardly from the sprinkler;*

*a gate valve mounted along the flow passage at an upstream side of the at least one removable spray nozzle, said gate valve being movable between an open position permitting substantially unobstructed water flow to said at least one removable spray nozzle and a closed position preventing water flow to said at least one removable spray nozzle;*

*said gate valve having a conical shaped side wall and defining an inlet, an outlet, and a flow path extending between said inlet and said outlet, said gate valve being rotatably supported within a valve chamber formed in said spray head at an upstream side of said at least one removable spray nozzle;*

*an inner surface portion of said conical shaped side wall of said gate valve defining a contour of said flow path between said inlet and said outlet, and an outer surface portion of said conical shaped side wall of said gate valve being in a sealing relation relative to said upstream side of the at least one removable spray nozzle when said gate valve is in said closed position; and*

*an actuator mounted to said spray head and coupled to said gate valve for rotatably displacing said gate valve between said open position with said flow path aligned with said at least one removable spray nozzle, and said closed position with said flow path misaligned with said at least one removable spray nozzle;* wherein [said flow path formed] *the inner surface portion of said conical shaped side wall being arcuate toward the at least one removable nozzle to form* in said gate valve [has] a generally elbow-shaped configuration *for the flow path that rotates with said gate valve between said open and said closed positions.*

4. The irrigation sprinkler of claim 2 wherein said gate valve is rotatable between said open position with a downstream end of said elbow-shaped flow path aligned with said *at least one removable* spray nozzle, and said closed position with said downstream end of said elbow-shaped flow path misaligned with said *at least one removable* spray nozzle.

5. The irrigation sprinkler of claim [1] *2* wherein said actuator comprises a pin rotatably mounted to said spray head for rotatably displacing said gate valve between said open and closed positions.

7. The irrigation sprinkler of claim [1] *2* wherein said actuator comprises an elongated pin rotatably mounted to said spray head and which is accessible from the exterior of said sprinkler.

9. The irrigation sprinkler of claim [1] *2* wherein the spray head is mounted at an upper end of a pop-up riser adapted to extend upwardly from the sprinkler housing upon coupling of the sprinkler housing to the supply of water under pressure.

10. The irrigation sprinkler of claim [1] *2* wherein *said sprinkler housing defines a bore for the at least one removable nozzle,* said gate valve has a generally conical shape defining said inlet formed in a base thereof, said outlet formed in [a] *the* conical side wall thereof, and said flow path having a generally elbow-shaped configuration extending from said inlet to said outlet, said conical gate valve being rotatably supported within said valve chamber *and* having a generally matingly shaped configuration formed in said spray head at an upstream side of said *bore for the at least one removable* spray nozzle, said actuator being accessible from the exterior of said sprinkler for rotatably displacing said conical gate valve between said open position with said outlet at a downstream end of said elbow-shaped flow path aligned with said *at least one removable* spray nozzle, and said closed position with said outlet misaligned with said *at least one removable* spray nozzle.

14. [The irrigation sprinkler of claim 12 wherein] *In an irrigation sprinkler having a sprinkler housing defining a flow passage for coupling a supply of water under pressure to a spray head having at least one spray nozzle mounted thereon for projecting the water outwardly from the sprinkler, the improvement comprising:*

*a gate valve mounted along the flow passage at an upstream side of the spray nozzle, said gate valve being movable between an open position permitting substantially unobstructed water flow to said spray nozzle and a closed position preventing water flow to said spray nozzle;*

*said gate valve defining an inlet, an outlet, and a flow path extending therein between said inlet and said outlet, said gate valve being rotatably supported within a valve chamber formed in said spray head at an upstream side of said spray nozzle;*

*an actuator mounted to said spray head and coupled to said gate valve for displacing said gate valve between said open position with said flow path aligned with said spray nozzle, and said closed position with said flow path misaligned with said spray nozzle;*

*said gate valve having a generally conical shape defining said inlet formed in a base thereof, said outlet formed in a conical side wall thereof, and said flow path having a generally elbow-shaped configuration extending from said inlet to said outlet, said conical gate valve being rotatably supported within said valve chamber having a generally matingly shaped configuration formed in said spray head at an upstream side of said spray nozzle, said actuator being accessible from the exterior of said sprinkler for rotatably displacing said conical gate valve between said open position with said outlet*

*at a downstream end of said elbow-shaped flow path aligned with said spray nozzle, and said closed position with said outlet misaligned with said at least one spray nozzle;*

*a valve stem extending upwardly from an apex end of said conical gate valve, said actuator being coupled to said valve stem for rotatably displacing said gate valve between said open and closed positions; and* said actuator further includes means for limiting rotational displacement of said gate valve to part-circle back-and-forth movement between said open and closed positions.

15. [The irrigation sprinkler of claim 14 wherein] *In an irrigation sprinkler having a sprinkler housing defining a flow passage for coupling a supply of water under pressure to a spray head having at least one spray nozzle mounted thereon for projecting the water outwardly from the sprinkler, the improvement comprising:*

*a gate valve mounted along the flow passage at an upstream side of the spray nozzle, said gate valve being movable between an open position permitting substantially unobstructed water flow to said spray nozzle and a closed position preventing water flow to said spray nozzle;*

*said gate valve defining an inlet, an outlet, and a flow path extending therein between said inlet and said outlet, said gate valve being rotatably supported within a valve chamber formed in said spray head at an upstream of said spray nozzle;*

*an actuator mounted to said spray head and coupled to said gate valve for displacing said gate valve between said open position with said flow path aligned with said spray nozzle, and said closed position with said flow path misaligned with said spray nozzle; and*

*said gate valve having a generally conical shape defining said inlet formed in a base thereof, said outlet formed in a conical side wall thereof, and said flow path having a generally elbow-shaped configuration extending from said inlet to said outlet, said conical gate valve being rotatably supported within said valve chamber having a generally matingly shaped configuration formed in said spray head at an upstream side of said spray nozzle, said actuator being accessible from the exterior of said sprinkler for rotatably displacing said conical gate valve between said open position with said outlet at a downstream end of said elbow-shaped flow path aligned with said spray nozzle, and said closed position with said outlet misaligned with said spray nozzle;*

*a valve stem extending upwardly from an apex end of said conical gate valve, said actuator being coupled to said valve stem for rotatably displacing said gate valve between said open and closed positions;*

*said actuator further including means for limiting rotational displacement of said gate valve to part-circle back-and-forth movement between said open and closed positions; and* said rotational displacement limiting means [restricts] *restricting* gate valve rotation to a rotational stroke of about 180 degrees.

16. The irrigation sprinkler of claim [11] *18* wherein said actuator pin is rotatably mounted within a generally cylindrical shaped opening through said spray head, and said detent means are flexible and formed between said actuator pin and said generally cylindrical shaped opening to provide an audible sound when said gate valve is displaced to said open and closed positions.

17. The irrigation sprinkler of claim [11] *18* wherein said actuator pin is rotatably mounted within a generally cylindrical shaped opening through said spray head, and said detent means are flexible and formed between said actuator pin and said generally cylindrical shaped opening to provide tactile feedback when said gate valve is displaced to said open and closed positions.

18. [The irrigation sprinkler of claim 11] *In an irrigation sprinkler having a sprinkler housing defining a flow passage for coupling a supply of water under pressure to a spray head having at least one spray nozzle mounted thereon for projecting the water outwardly from the sprinkler, the improvement comprising:*

*a gate valve mounted along the flow passage at an upstream side of the spray nozzle, said gate valve being movable between an open position permitting substantially unobstructed water flow to said spray nozzle and a closed position preventing water flow to said spray nozzle;*

*said gate valve defining an inlet, an outlet, and a flow path extending therein between said inlet and said outlet, said gate valve being rotatably supported within a valve chamber formed in said spray head at an upstream side of said spray nozzle;*

*an actuator mounted to said spray head and coupled to said gate valve for displacing said gate valve between said open position with said flow path aligned with said spray nozzle, and said closed position with said flow path misaligned with said spray nozzle;*

*said gate valve being a generally conical shape defining said inlet formed in a base thereof, said outlet formed in a conical side wall thereof, and said flow path having a generally elbow-shaped configuration extending from said inlet to said outlet, said conical gate valve being rotatably supported within said valve chamber having a generally matingly shaped configuration formed in said spray head at an upstream side of said spray nozzle, said actuator being accessible from the exterior of said sprinkler for rotatably displacing said conical gate valve between said open position with said outlet at a downstream end of said elbow-shaped flow path aligned with said spray nozzle, and said closed position with said outlet misaligned with said spray nozzle; and*

*said actuator comprises an elongated pin rotatably mounted within a generally cylindrical shaped opening through said spray head, and detent means are formed between said actuator pin and said generally cylindrical shaped opening to provide tactile feedback when said gate valve is displaced to said fully open and closed positions;* wherein said actuator pin is rotatably mounted within a generally cylindrical shaped opening through said spray head, and said detent means are formed between said actuator pin and said gate valve and provides tactile feedback when said gate valve is displaced to said fully open and closed positions.

19. [The irrigation sprinkler of claim 10 ] *In an irrigation sprinkler having a sprinkler housing defining a flow passage for coupling a supply of water under pressure to a spray head having at least one spray nozzle mounted thereon for projecting the water outwardly from the sprinkler, the improvement comprising:*

*a gate valve mounted along the flow passage at an upstream side of the spray nozzle, said gate valve being movable between an open position permitting substantially unobstructed water flow to said spray nozzle and a closed position preventing water flow to said spray nozzle;*

*said gate valve defining an inlet, an outlet, and a flow path extending therein between said inlet and said outlet, said gate valve being rotatably supported within a valve chamber formed in said spray head at an upstream side of said spray nozzle;*

*an actuator mounted to said spray head and coupled to said gate valve for displacing said gate valve between said open position with said flow path aligned with said spray nozzle, and said closed position with said flow path misaligned with said spray nozzle;*

*wherein said gate valve has a generally conical shape defining said inlet formed in a base thereof, said outlet formed in a conical side wall thereof, and said flow path having a generally elbow-shaped configuration extending from said inlet to said outlet, said conical gate valve being rotatably supported within said valve chamber having a generally matingly shaped configuration formed in said spray head at an upstream side of said spray nozzle, said actuator being accessible from the exterior of said sprinkler for rotatably displacing said conical gate valve between said open position with said outlet at a downstream end of said elbow-shaped flow path aligned with said spray nozzle, and said closed position with said oulet misaligned with said spray nozzle; and* wherein said conical side wall of said gate valve has a seal coating thereon.

20. The irrigation sprinkler of claim [10] *19* wherein said spray head further includes a seal lip for pressure-activated sealing engagement by said gate valve when said gate valve is in said closed position.

28. [The irrigation sprinkler of claim 27 wherein] *An irrigation sprinkler, comprising: a sprinkler housing adapted for connection to a supply of water under pressure, said sprinkler housing including a pop-up riser having a spray head at an upper end thereof, and at least one spray nozzle removably mounted on said spray head for projecting water outwardly from the sprinkler; a gate valve mounted on said spray head at an upstream side of said spray nozzle, said gate valve being movable between an open position permitting substantially unobstructed water flow to said spray nozzle and a closed position preventing water flow to said spray nozzle; said gate valve defining an inlet, an outlet, and a flow path extending therein between said inlet and said outlet, said gate valve being rotatably supported within a valve chamber formed in said spray head at an upstream side of said spray nozzle; and an actuator mounted to said spray head and coupled to said gate valve for displacing said gate valve between said open position with said flow path aligned with said spray nozzle, and said closed position with said flow path misaligned with said spray nozzle;*

*said flow path formed in said gate valve having a generally elbow-shaped configuration, said gate valve being rotatable between said open position with a downstream end of said elbow-shaped flow path aligned with said spray nozzle, and said closed position with said downstream end of said elbow-shaped flow path misaligned with said spray nozzle;*

*said gate valve has a generally conical shape defining said inlet formed in a base thereof, said outlet formed in a conical side wall thereof, and said flow path having a generally elbow-shaped configuration extending from said inlet to said outlet, said conical gate valve being rotatably supported within said valve chamber having a generally matingly shaped configuration formed in said spray head at an upstream side of said spray nozzle;*

*a valve stem extending upwardly from an apex end of said conical gate valve, said actuator means coupled to said valve stem for rotatably displacing said gate valve between said open and closed positions;*

*said actuator comprising an actuator pin accessible from the exterior of said sprinkler and having an externally exposed slotted upper end; and* said actuator means further [includes] *including* means for limiting rotational displacement of said gate valve to part-circle back-and-forth movement between said open and closed positions.

29. [The irrigation sprinkler of claim 28 wherein] *An irrigation sprinkler, comprising: a sprinkler housing adapted for connection to a supply of water under pressure, said sprinkler housing including a pop-up riser having a spray head at an upper end thereof, and at least one spray nozzle removably mounted on said spray head for projecting water outwardly from the sprinkler; a gate valve mounted on said spray head at an upstream side of said spray nozzle, said gate valve being movable between an open position permitting substantially unobstructed water flow to said spray nozzle and a closed position preventing water flow to said spray nozzle; said gate valve defining an inlet, an outlet, and a flow path extending therein between said inlet and said outlet, said gate valve being rotatably supported within a valve chamber formed in said spray head at an upstream side of said spray nozzle; and an actuator mounted to said spray head and coupled to said gate valve for displacing said gate valve between said open position with said flow path aligned with said spray nozzle, and said closed position with said flow path misaligned with said spray nozzle;*

*said flow path formed in said gate valve having a generally elbow-shaped configuration, said gate valve being rotatable between said open position with a downstream end of said elbow-shaped flow path aligned with said spray nozzle, and said closed position with said downstream end of said elbow-shaped flow path misaligned with said spray nozzle;*

*said gate valve having a generally conical shape defining said inlet formed in a base thereof, said outlet formed in a conical side wall thereof, and said flow path having a generally elbow-shaped configuration extending from said inlet to said outlet, said conical gate valve being rotatably supported within said valve chamber having a generally matingly shaped configuration formed in said spray head at an upstream side of said spray nozzle;*

*a valve stem extending upwardly from an apex end of said conical gate valve, said actuator means being coupled to said valve stem for rotatably displacing said gate valve between said open and closed positions;*

*said actuator comprising an actuator pin accessible from the exterior of said sprinkler and having an externally exposed slotted upper end;*

*said actuator means further including means for limiting rotational displacement of said gate valve to part-circle back-and-forth movement between said open and closed positions; and* said actuator pin is rotatably mounted within a generally cylindrical shaped opening through said spray head, and flexible detent means are formed between said actuator pin and said generally cylindrical shaped opening to provide an audible sound when said gate valve is displaced to said open and closed positions.

36. [The irrigation sprinkler of claim 35 wherein] *In an irrigation sprinkler having a sprinkler housing defining a*

*flow passage for coupling a supply of water under pressure to a spray head having at least one spray nozzle mounted thereon for projecting the water outwardly from the sprinkler, the improvement comprising: a gate valve mounted along the flow passage at an upstream side of the spray nozzle, said gate valve being movable between an open position permitting substantially unobstructed water flow to said spray nozzle and a closed position preventing water flow to said spray nozzle; said gate valve defining an inlet, an outlet, and a flow path extending therein between said inlet and said outlet, said gate valve being rotatably supported within a valve chamber formed in said spray head at an upstream side of said spray nozzle; and an actuator pin rotatably mounted to said spray head and coupled to said gate valve for displacing said gate valve between said open position with said flow path aligned with said spray nozzle, and said closed position with said flow path misaligned with said spray nozzle;*

*said actuator pin being rotatably mounted within a generally cylindrical shaped opening through said spray head and off-set from the centerline thereof, and said actuator pin has upper and lower ends, said lower end being rotatably coupled to said gate valve and said upper end being accessible from the exterior of said sprinkler; and*

*said actuator pin having teeth around the periphery of said lower end, and said gate valve has an enlarged flange adjacent its lower end, said flange having teeth formed around a portion of the periphery thereof and engaged with said teeth of said actuator pin;* said teeth formed on said flange of said gate valve [extend] *extending* 180 degrees around the periphery thereof, whereby rotation of said actuator pin can displace said gate valve 180 degrees between said fully open and closed positions.

*38. An irrigation sprinkler comprising:*

*a sprinkler housing defining a flow passage for coupling a supply of water under pressure to a spray head having at least one removable spray nozzle mounted on said spray head for projecting water outwardly from the sprinkler;*

*a gate valve mounted along the flow passage at an upstream side of the at least one removable spray nozzle, said gate valve being movable between an open position permitting substantially unobstructed water flow to said at least one removable spray nozzle and a closed position preventing water flow to said at least one removable spray nozzle;*

*said gate valve having a wall and defining an inlet, an outlet, and a flow path extending between said inlet and said outlet, said gate valve being rotatably supported within a valve chamber formed in said spray head at an upstream side of said at least one removable spray nozzle;*

*an inner surface portion of said wall of said gate valve defining a contour of said flow path between said inlet and said outlet, and an outer surface portion of said wall of said gate valve being in a sealing relation relative to said upstream side of the at least one removable spray nozzle when said gate valve is in said closed position;*

*an actuator mounted to said spray head and coupled to said gate valve for rotatably displacing said gate valve between said open position with said flow path aligned with said at least one removable spray nozzle, and said closed position with said flow path misaligned with said at least one removable spray nozzle; and*

*wherein the wall of said gate valve is configured to direct water between the inlet and outlet at an angle less than 90 degrees so that the flow of water is generally coaxial to and through the removable spray nozzle.*

* * * * *